US006964597B2

(12) United States Patent
Khuu

(10) Patent No.: US 6,964,597 B2
(45) Date of Patent: Nov. 15, 2005

(54) RETAINING RING WITH TRIGGER FOR CHEMICAL MECHANICAL POLISHING APPARATUS

(75) Inventor: Peter Khuu, Fremont, CA (US)

(73) Assignee: Khuu's Inc., Sunnyvale, CA (US)

( * ) Notice: Subject to any disclaimer, the term of this patent is extended or adjusted under 35 U.S.C. 154(b) by 131 days.

(21) Appl. No.: 10/609,064

(22) Filed: Jun. 27, 2003

(65) Prior Publication Data

US 2005/0014452 A1 Jan. 20, 2005

(51) Int. Cl.[7] ..... B24B 21/18
(52) U.S. Cl. ..... 451/5; 451/8; 451/398
(58) Field of Search ..... 451/5, 8, 41, 287, 451/288, 289, 285, 397, 398

(56) References Cited

U.S. PATENT DOCUMENTS

| | | | | |
|---|---|---|---|---|
| 5,944,593 | A * | 8/1999 | Chiu et al. | 451/442 |
| 6,227,009 | B1 | 5/2001 | Cusick et al. | |
| 6,368,189 | B1 * | 4/2002 | Maloney et al. | 451/41 |
| 6,390,908 | B1 * | 5/2002 | Chen et al. | 451/398 |

* cited by examiner

*Primary Examiner*—Jacob K. Ackun, Jr.
(74) *Attorney, Agent, or Firm*—Boris G. Tankhilevich

(57) ABSTRACT

A retaining ring for chemical mechanical polishing (CMP) apparatus comprising a body of the retaining ring, and a single trigger cavity, or a plurality of trigger cavities. Each trigger cavity formed inside the body of the retaining ring is filed with gas or fluid, and is configured to indicate that thickness of the retaining ring is less than or equal to a predetermined thickness threshold.

12 Claims, 11 Drawing Sheets

PRESSURE REGULATOR
PRESSURE REGULATOR
PRESSURE REGULATOR
COMPUTER
93b
98b
92b
90
96b
93c
98c
92c
96c
99
92a
98a
93a
96a
76
70a
74
87
80
78
72
66
94a
94c
94b
100

"SHAPE OF HOLE"

"POSITION OF O-RING"

RETAINING RING WITH TRIGGER FOR CHEMICAL MECHANICAL POLISHING APPARATUS

BACKGROUND OF THE INVENTION

1. Field of the Invention

The present invention is in the field of chemical mechanical polishing of substrates. More specifically, the present invention relates to a retaining ring for a chemical mechanical polishing apparatus.

2. Discussion of the Prior Art

In the prior art, the integrated circuits, particularly silicon wafers, are typically formed on substrates, by the sequential steps of laying out the conductive, semiconductive or insulative layers. After the deposition step is completed, the layer is etched to create circuitry features. As a series of layers are sequentially deposited and etched, the exposed surface of the substrate becomes largely non-planar. At some critical point, the non-planarity of the outer substrate surface creates problems for the next steps (for example, for the photolithographic steps) of the integrated circuit fabrication process. Therefore, the outmost (exposed) substrate surface is periodically planarized.

One of the most accepted methods of planarization is the method of chemical mechanical polishing (CMP). In the CMP planarization method the substrate should be mounted on a carrier or polishing head. The exposed surface of the substrate is placed against a rotating polishing pad. The polishing pad may be either a "standard" pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles, if a standard pad is used, is supplied to the surface of the polishing pad. The polishing slurry tends to be abrasive and corrosive, and can damage the mechanical parts inside the carrier head, including a retaining ring. When the thickness of the retaining ring becomes less than a predetermined thickness, it has to be replaced. If the retaining ring is not replaced in a timely manner, the substrate can be severely damaged.

Accordingly, there is a need to have a retaining ring with a triggering mechanism that can provide a signal to the computer program as to when the chemical mechanical polishing (CMP) process has to be stopped in order to replace the worn out retaining ring, after which the CMP process can be resumed without undue damage to the substrate.

SUMMARY OF THE INVENTION

To address the shortcomings of the available art, the present invention provides for a retaining ring with a triggering mechanism that provides a signal to the computer program as to when the chemical mechanical polishing (CMP) process has to be stopped in order to replace the worn out retaining ring.

One aspect of the present invention is directed to a retaining ring for chemical mechanical polishing (CMP) apparatus having a single triggering mechanism.

More specifically, in one embodiment of the present invention, the retaining ring for chemical mechanical polishing (CMP) apparatus having the single triggering mechanism comprises: a body of the retaining ring, a single trigger cavity, and an O-ring covering the single trigger cavity. The trigger cavity is formed inside the body of the retaining ring. In one embodiment, the single trigger cavity extends inside the body of the retaining ring at a depth level that is greater than or equal to a threshold depth level corresponding to a predetermined thickness threshold, and is configured to indicate that thickness of the retaining ring is less than or equal to the predetermined thickness threshold. In one embodiment of the present invention, the single trigger cavity is filled with gas, and the O-ring prevents the selected gas from escaping from the trigger cavity, wherein the gas is selected from the group consisting of: {air, Helium, Neon, Argon, Krypton, and Xenon}. In another embodiment of the present invention, the single trigger cavity is filled with fluid, and the O-ring covering trigger cavity prevents the fluid from escaping from the trigger cavity, wherein the fluid is selected from the group consisting of: {tap water, alcohols, glycols and water mixes}.

Another aspect of the present invention is directed to a retaining ring for chemical mechanical polishing (CMP) apparatus having a plurality of triggering mechanisms.

More specifically, in one embodiment of the present invention, the retaining ring for chemical mechanical polishing (CMP) apparatus comprises: a body of the retaining ring, an integer N of trigger cavities, and an integer M of O-rings, wherein each O-ring covers one trigger cavity.

In one embodiment of the present invention, a first trigger cavity is formed inside the body of the retaining ring, extends inside the body of the retaining ring at a first depth level $L_1$, and is configured to indicate that thickness of the retaining ring is less than a first predetermined thickness threshold.

In one embodiment of the present invention, a second trigger cavity is formed inside the body of the retaining ring, extends inside the body of the retaining ring at a second depth level $L_2$, and is configured to indicate that thickness of the retaining ring is less than a second predetermined thickness threshold.

In one embodiment of the present invention, an i-th trigger cavity is formed inside the body of the retaining ring, extends inside the body of the retaining ring at an i-th depth level $L_1$, and is configured to indicate that thickness of the retaining ring is less than an i-th predetermined thickness threshold. 'i' is an integer less than or equal to N. In one embodiment, $L_1 \geqq L_2 \geqq \ldots L_k \ldots \geqq L_N$.

In one embodiment of the present invention, each trigger cavity covered with the O-ring is filled with gas, wherein the O-ring prevents gas from escaping from the trigger cavity. The gas is selected from the group consisting of: {air, Helium, Neon, Argon, Krypton, and Xenon}.

In one embodiment of the present invention, each trigger cavity covered with the O-ring is filled with fluid, wherein the O-ring prevents fluid from escaping from the trigger cavity. The fluid is selected from the group consisting of: {tap water, alcohols, glycols and water mixes}.

One more aspect of the present invention is directed to a method of replacing a retaining ring in a chemical mechanical polishing (CMP) apparatus.

In one embodiment of the present invention, the retaining ring comprises a single trigger cavity formed inside the body of the retaining ring, and an O-ring covering the single trigger cavity. If each trigger cavity covered with the O-ring is filled with gas selected from the group consisting of: {air, Helium, Neon, Argon, Krypton, and Xenon}, the method of the present invention comprises the following steps: (A) filling the trigger cavity with the gas having a predetermined air pressure; (B) substantially continuously measuring and maintaining the predetermined air pressure of the selected gas in the trigger cavity; (C) performing a chemical mechanical polishing operation on a wafer by using the CMP apparatus having the retaining ring with the single trigger cavity under control of a computer loaded with a chemical mechanical polishing computer program; (D) if the air pressure in the single trigger cavity changes beyond a predetermined threshold level, using the chemical mechanical polishing computer program to stop the process of performing the chemical mechanical polishing operation on the wafer; (E) replacing the retaining ring; and (F) repeating the steps (A–E).

In one embodiment of the present invention, the step (A) further includes the step (A1) of pumping into the trigger cavity the selected gas having a predetermined positive air pressure by using the gas compressor; wherein the predetermined positive air pressure is greater than a normal air pressure; and wherein the step. (D) further includes the step of (D1) of using the chemical mechanical polishing computer program to stop the process of performing the chemical mechanical polishing operation on the wafer if the air pressure in the single trigger cavity drops below a first predetermined threshold level.

In one embodiment of the present invention, the step (A) further includes the step (A2) of pumping into the trigger cavity the selected gas having a predetermined negative air pressure by using a vacuum pump; wherein the predetermined negative air pressure is less than a normal air pressure; and wherein the step (D) further includes the step (D2) of using the chemical mechanical polishing computer program to stop the process of performing the chemical mechanical polishing operation on the wafer if the air pressure in the single trigger cavity increases above a second predetermined threshold level.

In one embodiment of the present invention, the retaining ring comprises a single trigger cavity formed inside of its body. If the trigger cavity covered with the O-ring is filled with fluid selected from the group consisting of: {tap water, alcohols, glycols and water mixes}, the method of the present invention comprises the following steps: (A) filling the trigger cavity with the selected fluid having a predetermined fluid pressure by using a fluid pump; (B) substantially continuously measuring and maintaining the pressure of the selected fluid in the trigger cavity; (C) performing a chemical mechanical polishing operation on a wafer by using the CMP apparatus having the retaining ring with the single trigger cavity under control of a computer loaded with a chemical mechanical polishing computer program; (D) if the pressure of the selected fluid in the single trigger cavity drops below a predetermined threshold level, using the chemical mechanical polishing computer program to stop the process of performing the chemical mechanical polishing operation on the wafer; (E) replacing the retaining ring; and (F) repeating the steps (A–E).

In one embodiment of the present invention, the retaining ring comprises a body, an integer N of trigger cavities, and an integer M of an O-rings, wherein the first trigger cavity extends inside the body of the retaining ring at a first depth level $L_1$, the second trigger cavity extends inside the body of the retaining ring at a second depth level $L_2$, and each k-th trigger cavity extends inside the body of the retaining ring at a k-th depth level $L_k$, and wherein $L_1 \geqq L_2 \geqq \ldots \geqq L_N$, k being an integer less than or equal to N.

In one embodiment of the present invention, each trigger cavity covered with the O-ring is filled with gas selected from the group consisting of: {air, Helium, Neon, Argon, Krypton, and Xenon}. In this embodiment of the present invention, the method comprises the following steps: (A) filling each trigger cavity with the selected gas; (B) substantially continuously measuring air pressure in each trigger cavity; (C) performing a chemical mechanical polishing operation on a wafer by using the CMP apparatus having the retaining ring with the plurality of trigger cavities under control of a computer loaded with a chemical mechanical polishing computer program; (D) if air pressure in the i-th trigger cavity changes beyond an i-th predetermined threshold level, using the chemical mechanical polishing computer program to issue an i-th warning signal; i being an integer less than N; (E) repeating the step (D) for each i-th trigger cavity; (F) if air pressure in the N-th trigger cavity changes beyond an N-th predetermined threshold level, using the chemical mechanical polishing computer program to stop the process of performing the chemical mechanical polishing operation on the wafer; (G) replacing the retaining ring; and (H) repeating the steps (A–G).

In one embodiment of the present invention, each trigger cavity covered with the O-ring is filled with fluid selected from the group consisting of: {tap water, alcohols, glycols and water mixes}. In this embodiment of the present invention, the method comprises the following steps: (A) filling each trigger cavity with the selected fluid; (B) substantially continuously measuring and maintaining pressure of the selected fluid in each trigger cavity; (C) performing a chemical mechanical polishing operation on a wafer by using the CMP apparatus having the retaining ring with the plurality of trigger cavities under control of a computer loaded with a chemical mechanical polishing computer program; (D) if pressure of the selected fluid in the i-th trigger cavity drops below an i-th predetermined threshold, using the chemical mechanical polishing computer program to issue an i-th warning signal; 'i' is an integer less than N; (E) repeating the step (D) for each i-th trigger cavity; (F) if pressure of the selected fluid in the N-th trigger cavity drops below an N-th predetermined threshold, using the chemical mechanical polishing computer program to stop the process of performing the chemical mechanical polishing operation on the wafer; (G) replacing the retaining ring; and (H) repeating the steps (A–G).

BRIEF DESCRIPTION OF DRAWINGS

The aforementioned advantages of the present invention as well as additional advantages thereof will be more clearly understood hereinafter as a result of a detailed description of a preferred embodiment of the invention when taken in conjunction with the following drawings.

DETAILED DESCRIPTION OF THE PREFERRED AND ALTERNATIVE EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
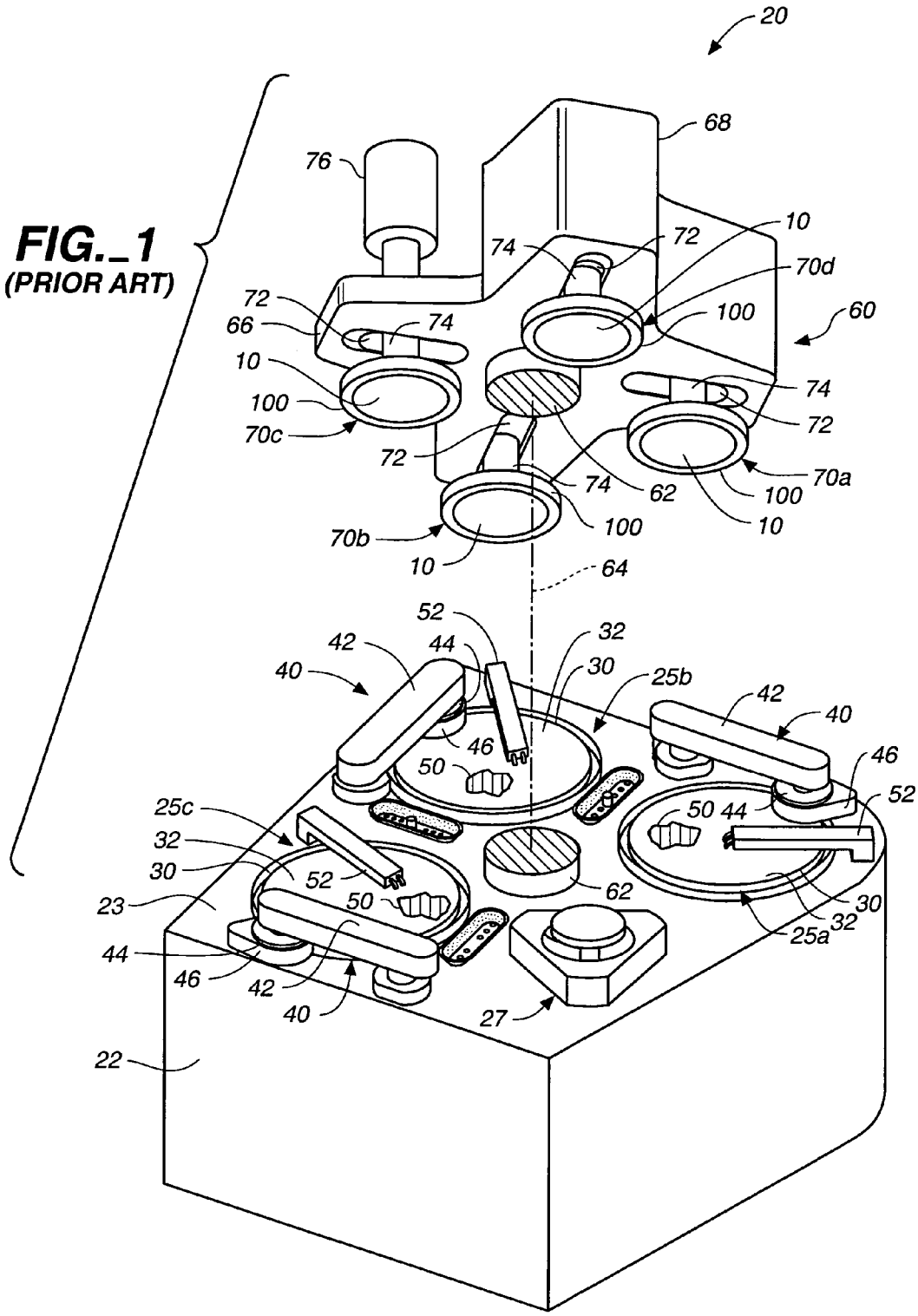
FIG. 1 (PRIOR ART)
FIG. 1 is an exploded perspective view of the prior art chemical mechanical polishing (CMP) apparatus.

FIG. 1 depicts a prior art chemical mechanical polishing (CMP) apparatus 20 that is configured to perform a chemical mechanical polishing operation on one or more substrates 10. There are several companies that use the CMP apparatus: Applied Materials, http://www.appliedmaterials.com/, LAM research, 4650 Cushing Parkway, Fremont, Calif. 94538, and ARIBA, 807 11th Avenue Sunnyvale, Calif. 94089.

More specifically, the CMP apparatus 20 includes a lower machine base 22, a table top 23 mounted on the lower machine base, and a removable-upper outer cover (not shown). Table top 23 supports a series of polishing stations 25*a*, 25*b* and 25*c*, and a transfer station 27. Transfer station 27 serves multiple functions of receiving individual substrates 10 from a loading apparatus (not shown), washing the substrates, loading the substrates into carrier heads (please, see description below), receiving the substrates from the carrier heads, washing the substrates again, and finally transferring the substrates back to the loading apparatus. As shown in FIG. 1, the transfer station 27 and the three polishing stations 25*a*, 25*b* and 25*c* form a square arrangement. Each polishing station 25*a*–25*c* includes a rotatable platen 30, and a polishing pad 32 placed on it. If substrate 10 is an eight-inch (200 millimeter) diameter disk, then platen 30 and polishing pad 32 are about twenty inches in diameter. Platen 30 is coupled to a platen drive motor (not shown) by a platen drive shaft (not shown). Each polishing station 25*a*–25*c* further includes an associated pad conditioner apparatus 40. Each pad conditioner apparatus 40 has a rotatable arm 42 holding an independently rotating conditioner head 44 and an associated washing basin 46. The conditioner apparatus maintains the condition of the polishing pad so that it will effectively polish any substrate pressed against it while it is rotating. The detailed description of the prior art chemical mechanical polishing (CMP) apparatus may be found in the U.S. Pat. No. 6,277,009, that is incorporated by reference herein in its entirety.

Referring still to FIG. 1, a slurry 50 containing a reactive agent (e.g., deionized water for oxide polishing) and a chemically-reactive catalyzer (e.g., potassium hydroxide for oxide polishing) is supplied to the surface of polishing pad 32 by a combined slurry/rinse arm 52. If polishing pad 32 is a standard pad, slurry 50 also includes abrasive particles (e.g., silicon dioxide for oxide polishing). Sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

Referring still to FIG. 1, a rotatable multi-head carousel 60, including a carousel support plate 66 and a cover 68, is positioned above lower machine base 22. Carousel support plate 66 is supported by a center post 62 and rotated thereon about a carousel axis 64 by a carousel motor assembly located within machine base 22. Multi-head carousel 60 includes four carrier head systems 70*a*, 70*b*, 70*c*, and 70*d* mounted on carousel support plate 66 at equal angular intervals about carousel axis 64. Three of the carrier head systems receive and hold substrates and polish them by pressing them against polishing pads of polishing stations 25*a*–25*c*. One of the carrier head systems receives a substrate from and delivers the substrate to transfer station 27. The carousel motor may orbit carrier head systems 70*a*–70*d*, and the substrates attached thereto, about carousel axis 64 between the polishing stations and the transfer station. Each carrier head system 70*a*–70*d* includes a polishing or carrier head 1100. Each carrier head 100 independently rotates about its own axis, and independently laterally oscillates in a radial slot 72 formed in carousel support plate 66 (please, see discussion below). A carrier drive shaft 74 extends through a drive shaft housing 78 (please, see discussion below) to connect a carrier head rotation motor 76 to carrier head 100 (shown by the removal of one-quarter of cover 68). There is one carrier drive shaft and motor for each head.

Figure 2:
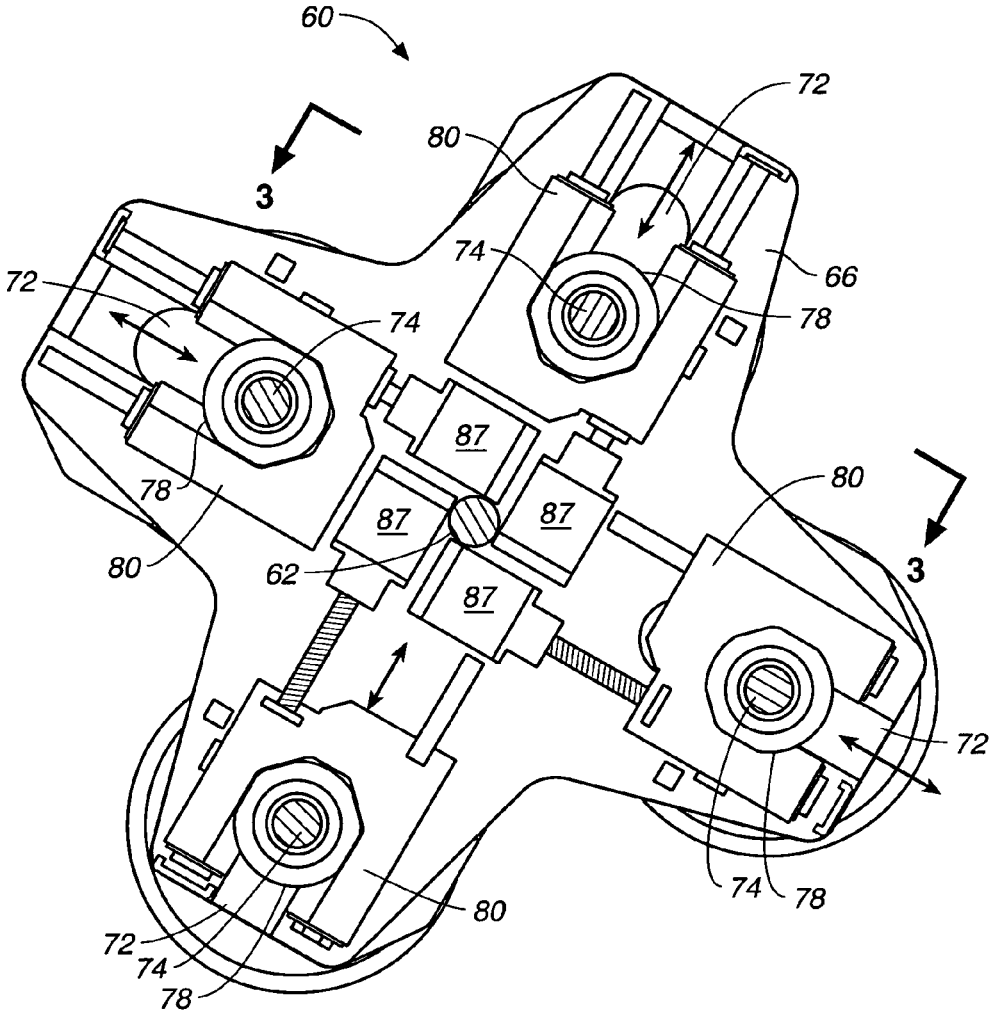
FIG. 2 (PRIOR ART)
FIG. 2 illustrates a schematic top view of the carousel of the prior art CMP apparatus of FIG. 1, with the upper housing removed.

FIG. 2 is a schematic top view of the carousel of the prior art CMP apparatus of FIG. 1, in which cover 68 of carousel 60 has been removed. The top of carousel support plate 66 supports four slotted carrier head support slides 80. Each slide 80 is aligned with one of radial slots 72 and may be driven along the slot by a radial oscillator motor 87. The four motors 87 are independently operable to independently move the four slides along radial slots 72 in carousel support plate 66.

Figure 3:
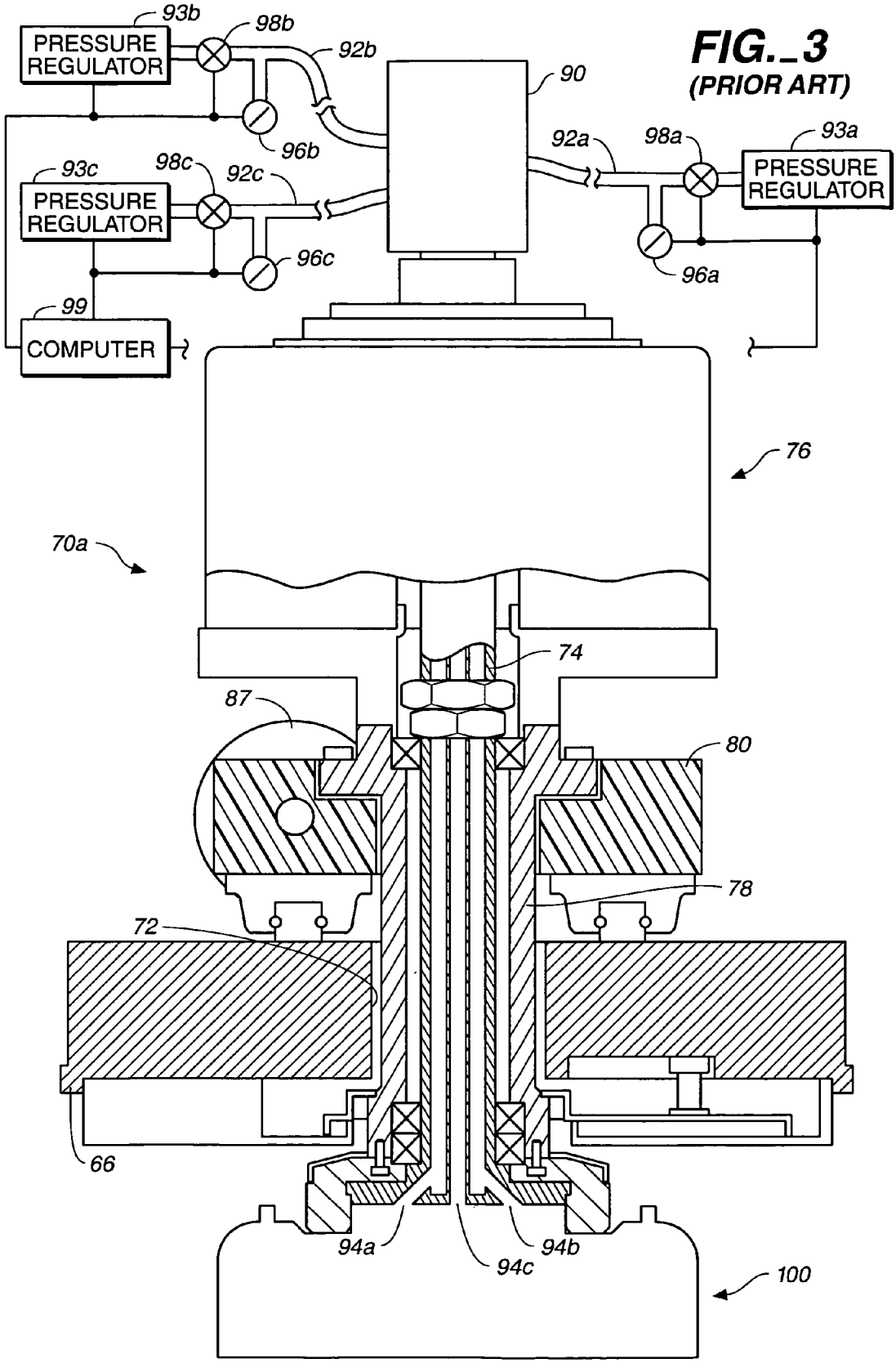
FIG. 3 (PRIOR ART)
FIG. 3 partially depicts a cross-sectional view of the carousel of FIG. 2 along line. 3—3, and partially a schematic diagram of the pressure regulators used by the prior art CMP apparatus of FIG. 1.

FIG. 3 is partially a cross-sectional view of the carousel of FIG. 2 along line 3—3, and partially a schematic diagram of the pressure regulators used by the prior art CMP apparatus of FIG. 1. As shown in FIG. 3, a rotary coupling 90 at the top of drive motor 76 couples three or more fluid lines 92*a*, 92*b* and 92*c* to three or more channels 94*a*, 94*b* and 94*c*, respectively, in drive shaft 74. Three vacuum or pressure sources 93*a*, 93*b* and 93*c*, such as pumps, venturis or pressure regulators (hereinafter referred to simply as "pumps"), may be connected to fluid lines 92*a*, 92*b* and 92*c*, respectively. Three pressure sensors or gauges 96*a*, 96*b* and 96*c* may be connected to fluid lines 92*a*, 92*b* and 92*c*, respectively, and control valves 98*a*, 98*b* and 98*c* may be connected across the fluid lines 92*a*, 92*b* and 92*c*, respectively. Pumps 93*a*–93*c*, pressure gauges 96*a*–96*c* and valves 98*a*–98*c* are appropriately connected to a general-purpose digital computer 99. Computer 99 controls the operation of pumps 93*a*–93*c*, as described in more detail below, to pneumatically power carrier head 100.

Referring still to FIG. 1, during actual polishing, three of the carrier heads, e.g., those of carrier head systems 70*a*–70*c*, are positioned at and above respective polishing stations 25*a*–25*c*. Each carrier head 100 lowers a substrate into contact with polishing pad 32. As stated above, slurry 50 acts as the media for chemical mechanical polishing of the substrate. Generally, carrier head 100 holds the substrate in position against the polishing pad and distributes a force across the back surface of the substrate. The carrier head also transfers torque from the drive shaft to the substrate.

Figure 4:
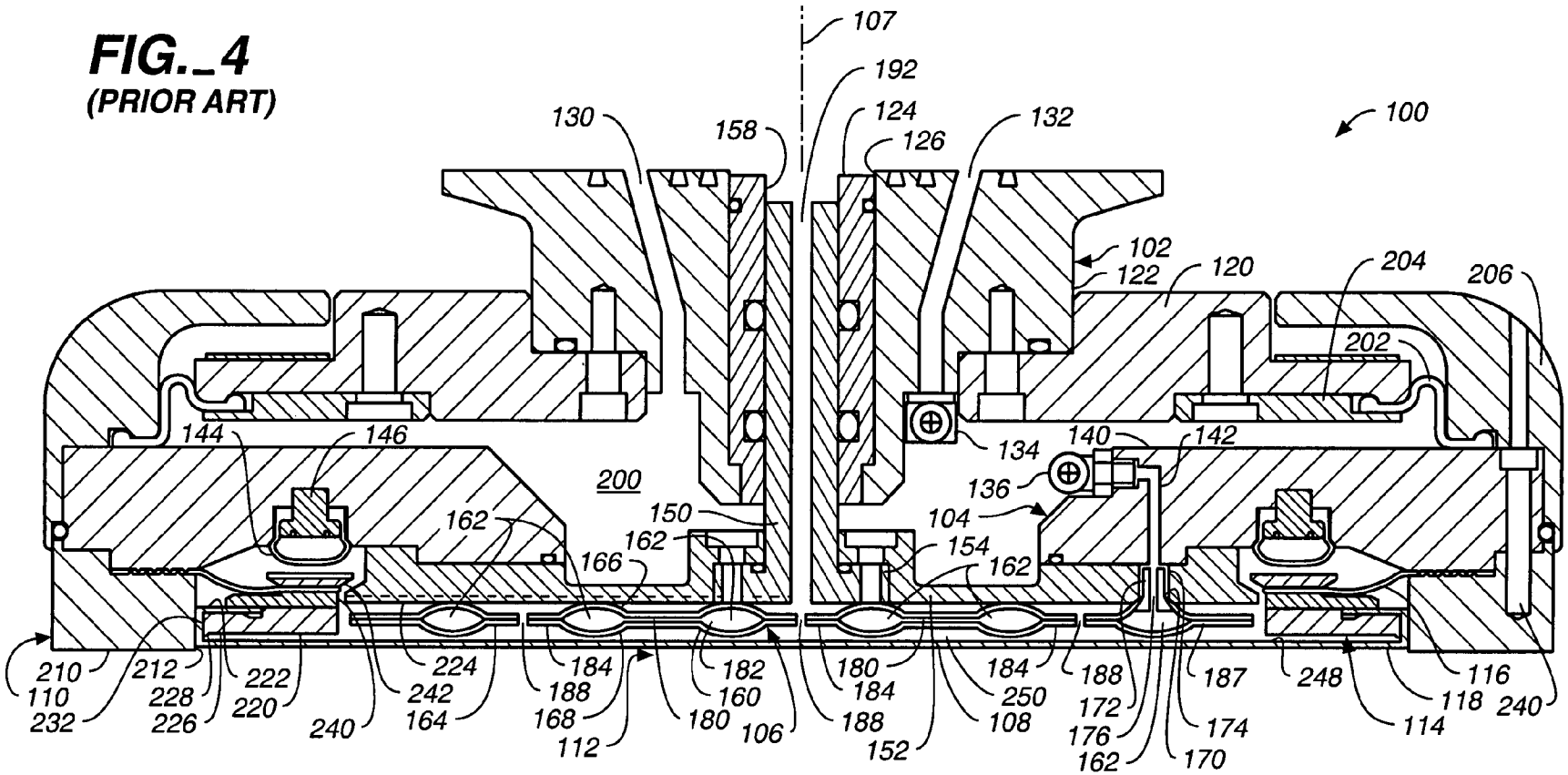
FIG. 4 (PRIOR ART)
FIG. 4 is a schematic cross-sectional view of a carrier head of the prior art CMP apparatus of FIG. 1.

FIG. 4 illustrates a schematic cross-sectional view of a carrier head 100 of the prior art CMP apparatus of FIG. 1. As shown in FIG. 4, carrier head 100 includes a housing 102, a base 104, a flexible member or membrane 118, a compliant backing member 106, and a retaining ring 110. The housing 102 can be connected to drive shaft 74 to rotate therewith about an axis of rotation 107 which is substantially perpendicular to the surface of the polishing pad. A loading chamber 200 is located between housing 102 and base 104 to apply a load, i.e., a downward pressure, to base 104. The vertical position of base 104 relative to polishing pad 32 is also controlled by means of loading chamber 200. The flexible membrane 118 may be connected to base 104 by a support structure 114 and a flexure diaphragm 116. The flexible membrane 118 is attached to support structure 114, and the support structure is suspended beneath base 104 by flexure diaphragm 116. The flexible membrane 118 extends below base 104 to provide a mounting surface 108 for the substrate. Pressurization of a chamber 250 defined by flexible membrane 118 presses the substrate against the polishing pad. The housing 102 is generally circular in shape to correspond to the circular configuration of a substrate to be polished. The housing includes an annular housing plate 120 and a generally cylindrical housing hub 122. The housing plate 120 may surround and be affixed to housing hub 122. A cylindrical bushing 124 may fit into a vertical bore 126 through the housing hub to connect the housing to the gimbal mechanism. The base 104 includes a generally ring-shaped body 140 located beneath housing 102. A flexible membrane 144 may be attached to the lower surface of base 104 by a clamp ring 146 to create a compressible bladder. A passage 142 may extend through the base to provide fluid communication with the bladder created by membrane 144. The base 104 may also include a gimbal rod 150 and a flexure ring 152. The upper end of gimbal rod 150 fits into a passage 158 through cylindrical bushing 124. The lower end of gimbal rod 150 includes an annular flange 154 which is secured to an inner portion of flexure ring 152. The outer portion of flexure ring 152 is secured to body 140. Gimbal rod 150 may slide vertically within passage 158 so that base 104 may move vertically with respect to housing 102. However, gimbal rod 150 prevents any substantial lateral motion of base 104 with respect to housing 102. The flexure ring 152 is sufficiently flexible to permit body 104 to pivot with respect to housing 102 so that it remains substantially parallel to the surface of th polishing pad during polishing.

Referring still to FIG. 4, the retaining ring 110 may be secured at the outer edge of base 104. Retaining ring 110 is a generally annular ring having a bottom surface 210 to contact the polishing pad. The bottom surface 210 may be substantially flat, or it may have grooves or channels to permit slurry to reach substrate. An inner surface 212 of retaining ring 110 defines, in conjunction with mounting surface 108 of flexible membrane 118, a substrate receiving recess 112. The retaining ring 110 holds the substrate in the substrate-receiving recess and transfers the lateral load from the substrate to the base. When fluid is directed into loading chamber 200 and base 104 is pushed down, retaining ring 110 is also pushed down to apply a load to polishing pad 32.

Figure 5:
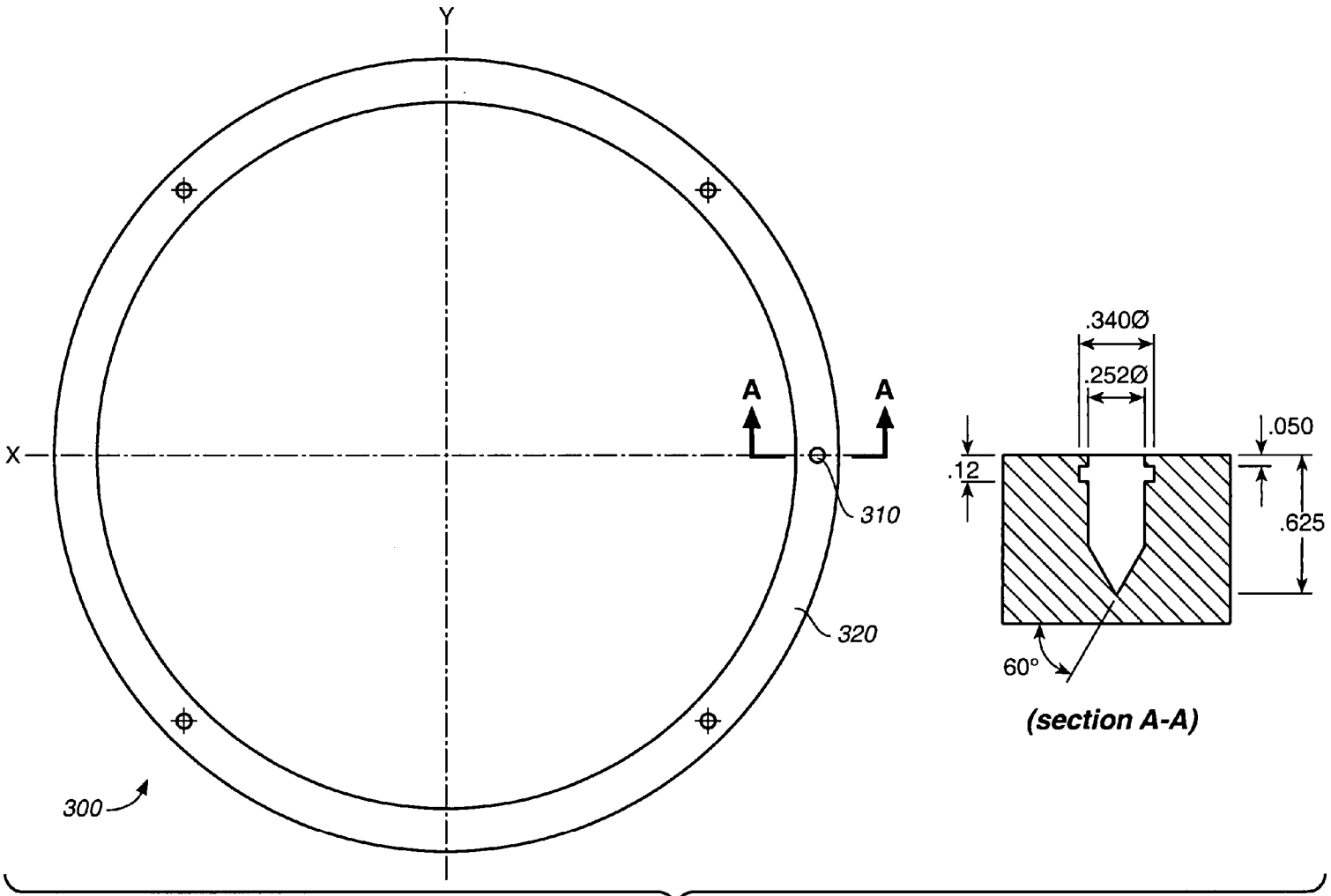
FIG. 5 depicts the retaining ring for chemical mechanical polishing (CMP) apparatus of the present invention having a single trigger cavity, and an O-ring covering the single trigger cavity.

In one embodiment of the present invention, as shown in FIG. 5, the retaining ring for chemical mechanical polishing (CMP)-apparatus having the single triggering mechanism comprises: a body of the retaining ring 320, a single trigger cavity 310, and an O-ring covering the single trigger cavity (please, see discussion below of FIG. 6).

In one embodiment of the present invention, the trigger cavity 310 is formed inside the body 320 of the retaining ring. FIG. 6 shows a cross-sectional view 400 of the trigger cavity of FIG. 5 along line A—A, including an O-ring 410, and a gas or fluid line 440, a control valve 460, a pressure gauge 450, a pressure regulator (or pump) 470, and computer 480.

Figure 6:
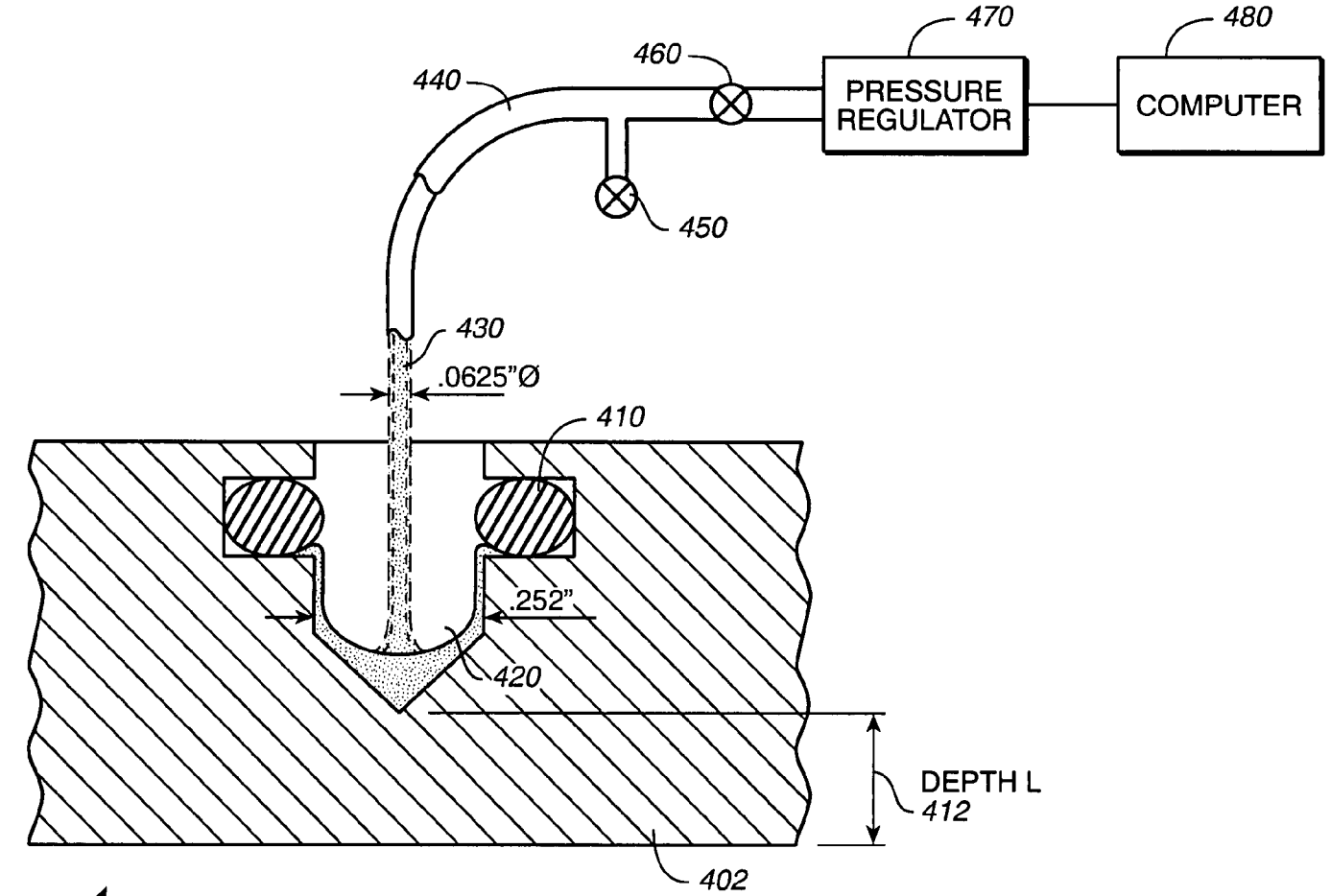
FIG. 6 shows a cross-sectional view of the trigger cavity of FIG. 5 along line A—A, including an O-ring, and a pressure regulator (or pump) for pumping gas or fluid into the trigger cavity, and pressure gauge for measuring the pressure of gas or fluid inside the trigger cavity.

In one embodiment, as shown in FIG. 6, the single trigger cavity 420 extends inside the body 402 of the retaining ring at a depth level L 412 that is greater than or equal to a threshold depth level $L_{threshold}$ corresponding to a predetermined thickness threshold. If this is the case, the single trigger cavity 420 is configured to indicate that thickness of the retaining ring 400 is less than or equal to the predetermined thickness threshold $L_{threshold}$ (that cannot exceed the thickness of the retaining ring itself).

In one embodiment of the present invention, the single trigger cavity is filled with gas, and the O-ring prevents the selected gas from escaping from the trigger cavity, wherein the gas is selected from the group consisting of: {air, Helium, Neon, Argon, Krypton, and Xenon}.

The O-rings provide a reliable seal in static (axial and radial squeezed) and dynamic (reciprocating, oscillating, and rotary) applications. Standard sizes are set by Aerospace Standard AS568A and designated by dash numbers. Metric sizes are measured by their width (cross sections) and ID; they are not designated by the dash numbers. The McMaster-CARR Catalog 109 of O-rings is the most current and is published in Los Angeles, Calif. O-rings are manufactured by using different materials, including Polyurethane, Neoprene, Buna-N, Viton, Teflon, Kalrez, Ethylene Propylene (EPDM), and Silicone. The material of the O-ring can be selected so that O-ring can reliably seal gas or fluid in each trigger cavity.

The air pressure in the trigger cavity can be measured within ±0.5% max. psi ranges by using P300 Pressure Sensors manufactured by Pace Scientific Inc., 542 Williamson Rd Suite 6, Mooresville, N.C. 28117 USA. P300 Series are designed to measure the air pressure for dry air and inert gases in the range ±1 Inch $H_2O$ to 0–30 psi.

In another embodiment of the present invention, the single trigger cavity is filled with fluid, and the properly selected O-ring prevents the fluid from escaping from the trigger cavity, wherein the fluid is selected from the group consisting of: {tap water, alcohols, glycols and water mixes}. The tap water is further selected from the group consisting of: {deionized water, demineralized water, and potable, water}. The alcohols and glycols are further selected from the group consisting of: {Ethanol, Methanol, Butanol, Isopropyl, Isobutyl, Ethylene glycol, Propylene, and Glycol}.

It is well know that all fluids-both liquids and gases exert pressure. A fluid at rest exerts equal pressure in all directions. One can use three different gauges to find the pressure of fluids: Bourdon gauge, Schrader gauge, and diaphragm gauge. Within the Bourdon gauge (not shown) is a thin-walled metal tube, somewhat flattened and bent into the form of a C. Attached to its free end is a lever system that magnifies any motion of the free end of the tube. On the fixed end of the gauge is a fitting you thread into a boiler system. As pressure increases within the boiler, it travels through the tube. Like the snakelike paper whistle, the metal tube begins to straighten as the pressure increases inside of it. As the tube straightens, the pointer moves around a dial that indicates the pressure in psi.

The Bourdon gauge is a highly accurate but rather delicate instrument. One can easily damage it. In addition, it malfunctions if pressure varies rapidly. This problem was overcome by the development of another type of gauge, the Schrader. The Schrader gauge (not shown) is not as accurate as the Bourdon, but it is sturdy and suitable for ordinary hydraulic pressure measurements. It is especially suitable for fluctuating loads. In the Schrader gauge, liquid pressure actuates a piston. The pressure moves up a cylinder against the resistance of a spring, carrying a bar or indicator with it over a calibrated scale. The operation of this gauge eliminates the need for cams, gears, levers, and bearings. The diaphragm gauge gives sensitive and reliable indications of small pressure differences. In this type of gauge, a diaphragm connects to a pointer through a metal spring and a simple linkage system (not shown). One side of the diaphragm is exposed to the pressure being measured, while the other side is exposed to the pressure of the atmosphere. Any increase in the pressure line moves the diaphragm upward against the spring, moving the pointer to a higher reading. When the pressure decreases, the spring moves the diaphragm downward, rotating the pointer to a lower reading. Thus, the position of the pointer is balanced between the pressure pushing the diaphragm upward and the spring action pushing down. When the gauge reads 0, the pressure in the line is equal to the outside air pressure. Bourdon gauge, Schrader gauge, or diaphragm gauge can be ordered on-line via "The Integrated Publishing 26838I45 North, PMB, 102 Spring, Tex. 77386, USA.

Figure 7A:
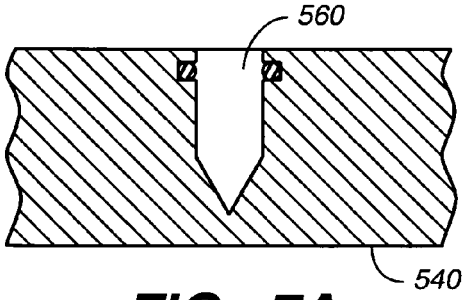
FIGS. 7A–7E depict the different shapes of the trigger cavity, including the rectangular shape, the cylindrical shape, the pyramidal shape, and different positions of the O-ring inside the trigger cavity.
Figure 7B:
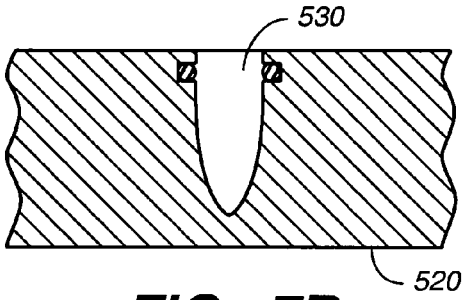
Figure 7C:
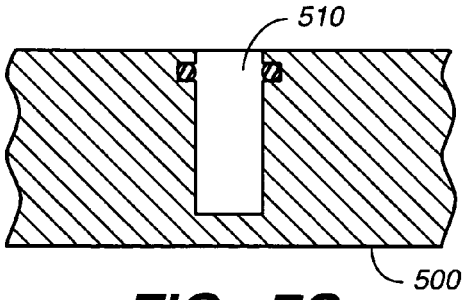
Figure 7D:
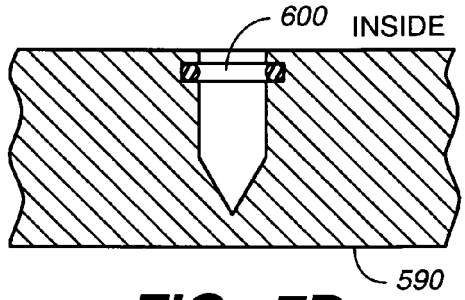
Figure 7E:
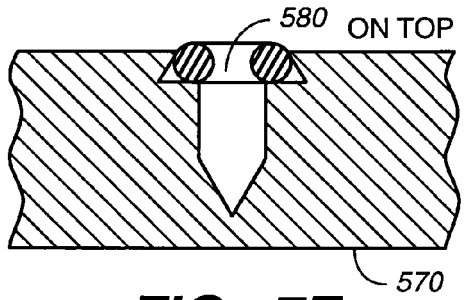
Figure 7F:
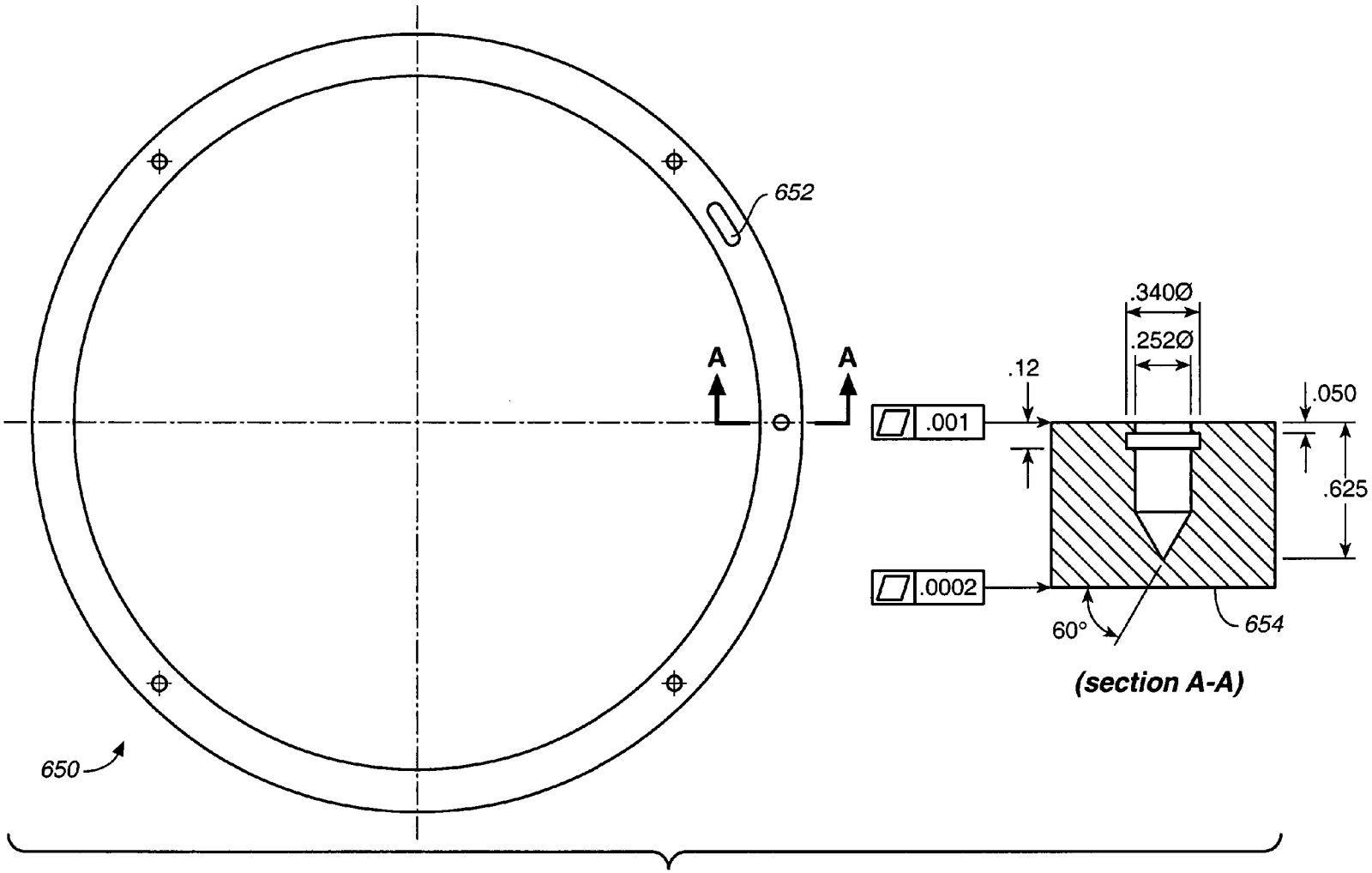
FIGS. 7F depicts the slot shape of the trigger cavity.

FIGS. 7A–7C illustrate the different shapes of the trigger cavity, including the rectangular shape 510, cylindrical shape 530, and pyramidal shape 560. FIG. 7F shows the slot shape 652 of the trigger cavity. FIGS. 7D–7E illustrate different positions of the O-ring 580 and 600 inside the trigger cavity.

Figure 8:
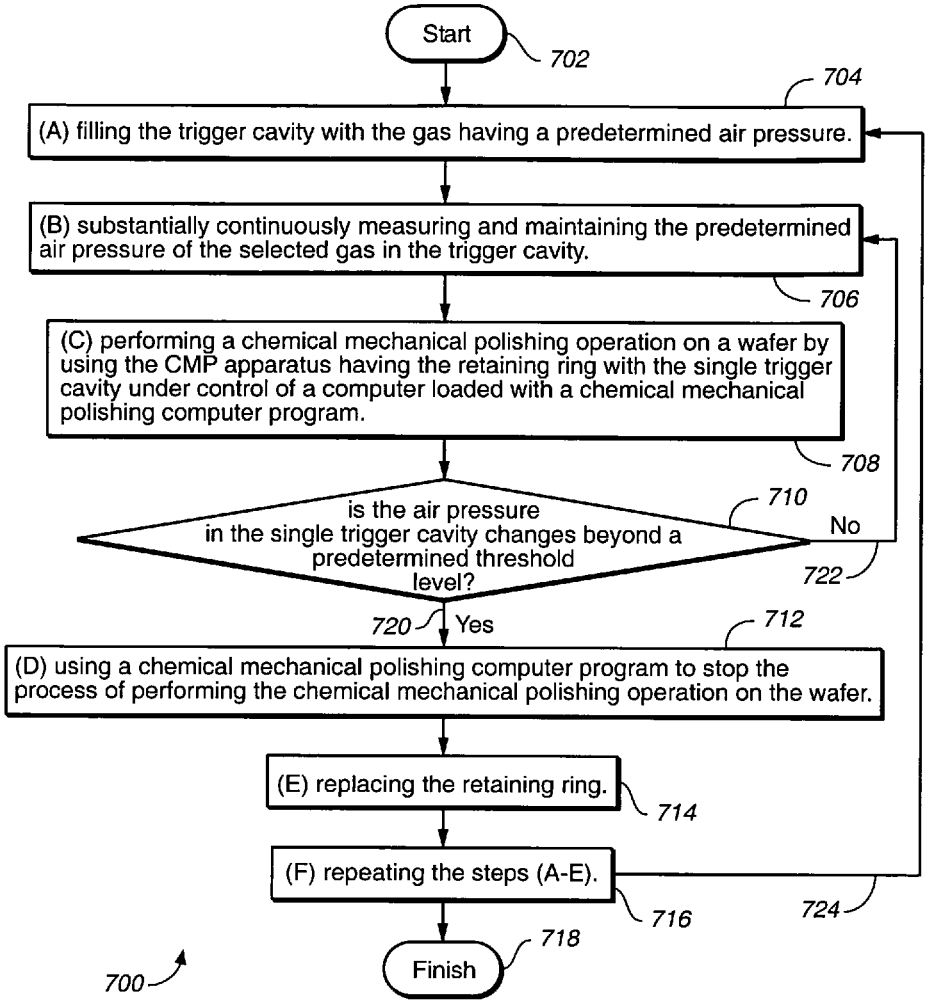
FIG. 8 illustrates a flow chart of the method of the present invention of replacing a retaining ring in a chemical mechanical polishing (CMP) apparatus, whereas the retaining ring includes a single trigger cavity.

FIG. 8 illustrates a flow chart 700 of the method of the present invention of replacing a retaining ring in a chemical mechanical polishing (CMP) apparatus. In one embodiment, the flow chart 700 comprises the following steps. At the first step 704, the trigger cavity is filled with the gas having a predetermined air pressure. The positive air pressure, that is the air-pressure that is greater than the atmosphere air pressure can be pumped in the range of 1 psi to 30 psi by using a pressure regulator, or pump 450 of FIG. 6. At the next step 706 (of FIG. 8), the predetermined air pressure of the selected gas in the trigger cavity is being substantially continuously measured and maintained by using control valve 460 and pressure regulator, or pump 450 of FIG. 6. ControlAir Inc., (8 Columbia Drive, Amherst, N.H., 03031 USA) is a leading manufacturer of general and precision air pressure regulators, I/P transducers, E/P transducers and frictionless diaphragm air cylinders.

At the next step 708, a chemical mechanical polishing operation on a wafer is performed by using the CMP apparatus 20 (of FIG. 1) having the retaining ring with the single trigger cavity under control of a computer 480 (of FIG. 6) loaded with a chemical mechanical polishing computer program. The E2 Shop System, (http://www.shoptech-corp.com/) provides a software package that can be modified to perform a chemical mechanical polishing operation on a wafer by using the retaining ring with at least one trigger cavity.

If the air pressure in the single trigger cavity changes beyond a predetermined threshold level, that is if the test condition 710 (of FIG. 8) is satisfied, the flow chart 700 follows the logical arrow 720 to the next step 712 of using the chemical mechanical polishing computer program to stop the process of performing the chemical mechanical polishing operation on the wafer, so that the operator can mechanically replace the worn out retaining ring (step 716). The steps (704–716) are preferably repeated.

If, on the other hand, the test condition 710 fails, that is the air pressure in the single trigger cavity does not change beyond a predetermined threshold level, the trigger cavity is still undamaged by the chemical mechanical polishing process. If this is the case, the steps (706–708) are preferably repeated until the trigger cavity (310 of FIG. 5) of the retaining ring is damaged and the gas pressure inside the trigger cavity changes beyond a predetermined pressure threshold level, after which the test 710 passes, and the retaining ring is replaced, as was described above. The predetermined pressure threshold level can be selected depending on the sensitivity of the material of the substrate being chemically polished. If the substrate material IS very sensitive and can be easily damaged by less than perfect retaining ring, the initial, even a very small damage to the trigger cavity should be enough to cause the chemical polishing process to stop. For example, the predetermined pressure threshold level should be less than 0.01 psi.

In one embodiment of the present invention, the step 704 of flow chart 700 (of FIG. 8) further includes the step (not shown) of pumping into the trigger cavity the selected gas having a predetermined positive air pressure by using the pressure regulator 470 (of FIG. 6). In this embodiment of the present invention, the predetermined positive air pressure is greater than a normal air pressure, and the step (712 of FIG. 8) further includes the step of (not shown) using the chemical mechanical polishing computer program to stop the process of performing the chemical mechanical polishing operation on the wafer if the air pressure in the single trigger cavity drops below a first predetermined threshold level. For example, if substrate is very sensitive, the first predetermined pressure threshold level should be less than 0.01 psi.

In another embodiment of the present invention, the step (704 of FIG. 8) further includes the step (not shown) of pumping into the trigger cavity the selected gas having a predetermined negative air pressure by using a vacuum pump (470 of FIG. 6). In this embodiment, the predetermined negative air pressure is less than a normal air pressure, and the step (712 of FIG. 8) further includes the step (not shown) of using the chemical mechanical polishing computer program to stop the process of performing the chemical mechanical polishing operation on the wafer if the air pressure in the single trigger cavity increases above a second predetermined threshold level. If the substrate material is very sensitive, the second predetermined pressure threshold level should be less than 0.01 psi.

In one embodiment of the present invention, the retaining ring comprises a single trigger cavity formed inside of its body. If the trigger cavity covered with the O-ring is filled with fluid selected from the group consisting of: {tap water, alcohols, glycols and water mixes}, the method of the present invention comprises the following steps (not shown): (A) filling the trigger cavity with the selected fluid having a predetermined fluid pressure by using a fluid pump (470 of FIG. 6), (B) substantially continuously measuring and maintaining the pressure of the selected fluid in the trigger cavity (by using one of the described above fluid pumps like Bourdon gauge, Schrader gauge, or diaphragm gauge), (C) performing a chemical mechanical polishing operation on a wafer by using the CMP apparatus having the retaining ring with the single trigger cavity under control of a computer loaded with a chemical mechanical polishing computer program; (D) if the pressure of the selected fluid in the single trigger cavity drops below a predetermined threshold level, using the chemical mechanical polishing computer program to stop the process of performing the chemical mechanical polishing operation on the wafer, and (E)-replacing the retaining ring. The steps (A–E) are preferably repeated.

Another aspect of the present invention is directed to a retaining ring for chemical mechanical polishing (CMP) apparatus 20 (of FIG. 1) having a plurality of triggering mechanisms.

Figure 9:
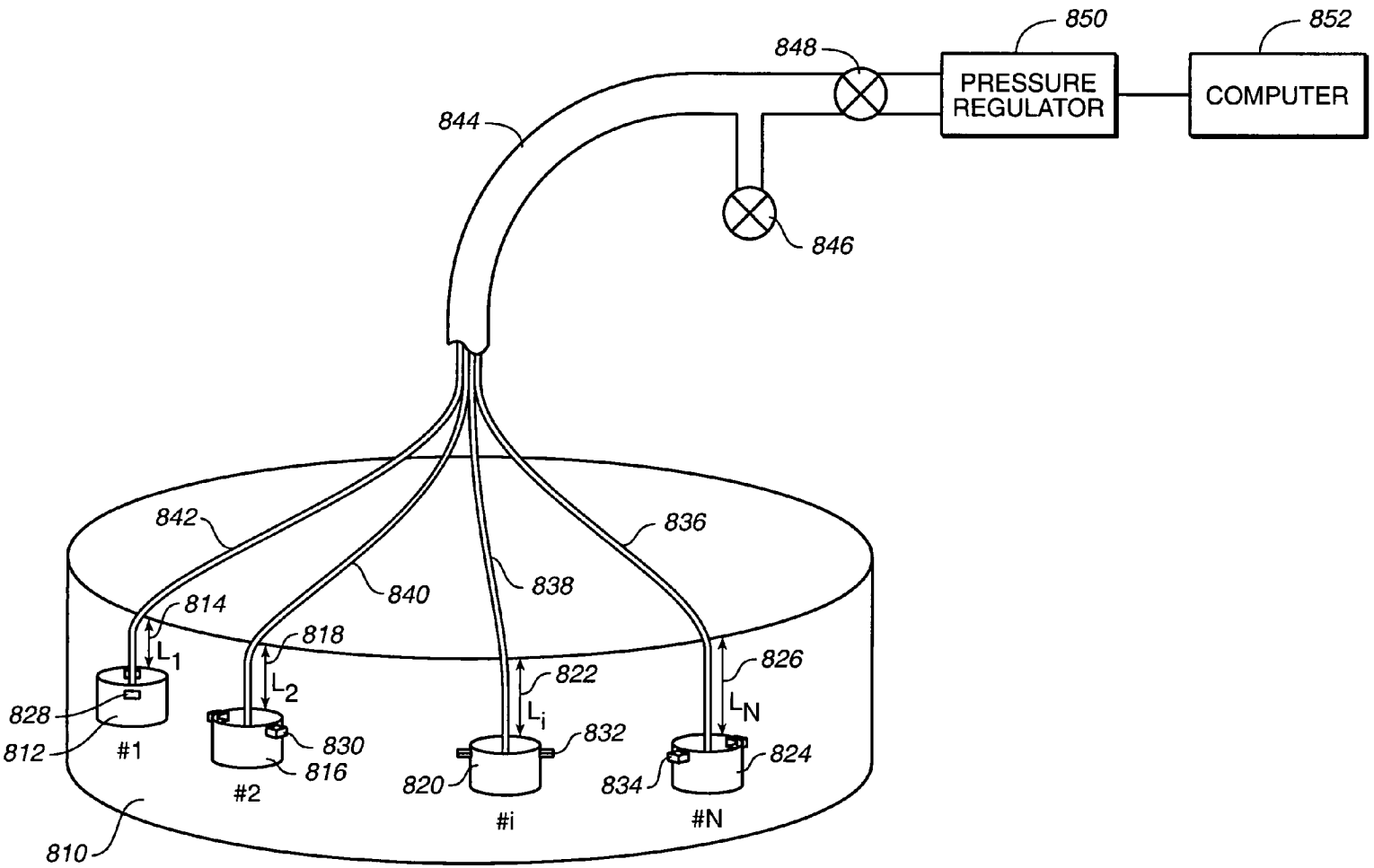
FIG. 9 shows the retaining ring of the present invention comprising an integer N of trigger cavities, and an integer M of O-rings, wherein each O-ring covers one trigger cavity.

More specifically, as depicted in FIG. 9, in one embodiment of the present invention, the retaining ring 800 for chemical mechanical polishing (CMP) apparatus 20 (of FIG. 1) comprises: a body of the retaining ring 810, an integer N of trigger cavities (812, 816, . . . 820, . . . 824), and an integer M of O-rings (828, 830, . . . 832, . . . 834). Each O-ring covers one trigger cavity.

In one embodiment of the present invention, as shown in FIG. 9, a first trigger cavity 812 is formed inside the body 810 of the retaining ring 800, extends inside the body of the retaining ring at a first depth level L, 814 and is configured to indicate that thickness of the retaining ring is less than a first predetermined thickness threshold. In one embodiment of the present invention, as also shown in FIG. 9, a second trigger cavity 816 is formed inside the body 810 of the retaining ring, extends inside the body of the retaining ring 810 at a second depth level $L_2$ 818 and is configured to indicate that thickness of the retaining ring is less than a second predetermined thickness threshold. In one embodiment of the present invention, a plurality of i-th trigger cavities 820, 824 (of FIG. 9) are also formed inside the body of the retaining ring 810. These extra cavities extend inside the body of the retaining ring at i-th depth level $L_1$ 822, . . . and at N-th depth level $L_N$ 826 respectively, and are configured to indicate that thickness of the retaining ring is less than each predetermined thickness threshold. Herein, 'i' is an integer less than or equal to N. In one embodiment, the sequence of predetermined thickness thresholds is as follows: $L_1 \geqq L_2 \geqq \ldots L_k \ldots \geqq L_N$.

In one embodiment of the present invention, each trigger cavity 814, 816, . . . , 820, . . . 824 (of FIG. 9) is covered with the O-ring (828, 830, . . . 832, . . . 834) respectively, and is filled with gas. Each O-ring prevents gas from escaping from one trigger cavity. The gas is selected from the group consisting of: {air, Helium, Neon, Argon, Krypton, and, Xenon}.

Figure 10:
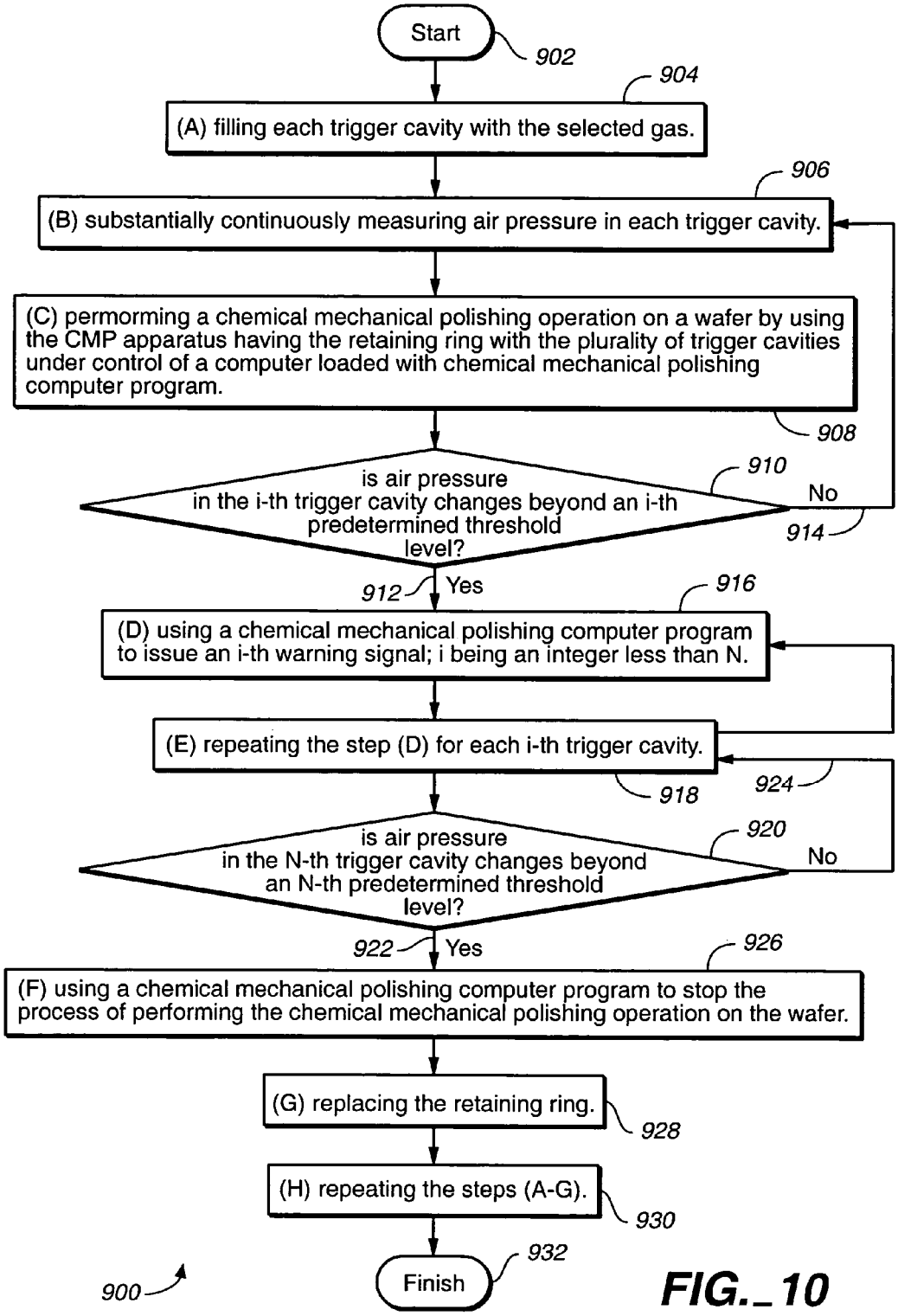
FIG. 10 illustrates the flow chart of the method of the present invention of replacing a retaining ring in a chemical mechanical polishing (CMP) apparatus, when the retaining ring includes a plurality of N trigger cavities.

FIG. 10 illustrates the flow chart 900 of the method of the present invention of replacing a retaining ring in a chemical, mechanical polishing (CMP) apparatus, when the retaining ring includes a plurality of N trigger cavities filled with gas. In this embodiment, the method of the present invention comprises the following initial steps: (step 904) filling each trigger cavity with the selected gas, (step 906) substantially continuously measuring and maintaining pressure of the selected gas in each trigger cavity, and (step 908) performing a chemical mechanical polishing operation on a wafer by using the CMP apparatus having the retaining ring with the plurality of trigger cavities under control of a computer loaded with a chemical mechanical polishing computer program.

If the test condition 910 is satisfied, that is if pressure of the selected gas in the i-th trigger cavity changes beyond an i-th predetermined threshold, the flow chart follows the logical arrow 912, and the next steps are: the step (916) of using the chemical mechanical polishing computer program to issue an i-th warning signal; 'i' is an integer less than N, and the step (918) of repeating the step (916) for each i-th trigger cavity. If, on the other hand, the test condition 910 fails, that is if pressure of the selected gas in the i-th trigger cavity does not change beyond the i-th predetermined threshold, the steps (906–908) are repeated.

The next test condition 920 is as follows: whether the pressure of the selected gas in the N th-trigger changes beyond an N-th predetermined threshold? If the answer is yes, the flow chart follows the logical arrow 922 and the next steps are as follows: (step 926) using the chemical mechanical polishing computer program to stop the process of performing the chemical mechanical polishing operation on the wafer, and (step 928) replacing the retaining ring. The steps (904–928) are preferably repeated.

If, on the other had, the test condition 920 fails, the flow chart 900 of FIG. 10 follows the logical arrow 924 and the step 918 is repeated again.

Referring still to FIG. 9, in one embodiment of the present invention, each trigger cavity 814, 816, . . . , 820, . . . 824 (of FIG. 9) is covered with the O-ring (828, 830, . . . 832, . . . 834) respectively, and is filled with fluid, wherein the O-ring prevents fluid from escaping from the trigger cavity. The fluid is selected from the group consisting of: {tap water, alcohols, glycols and water mixes}.

In this embodiment, the flow chart 900 of FIG. 10 also can be used to describe the method of the present invention of replacing the retaining ring including the plurality of trigger cavities filled with fluid, whereas each trigger cavity filled with fluid is configured to cause the computer program to issue the corresponding warning signal, or ultimately, to stop the CMP process so that the operator can replace the retaining ring.

The foregoing description of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A retaining ring for chemical mechanical polishing (CMP) apparatus comprising:

a body of said retaining ring;

and a single trigger cavity; said single trigger cavity further including:

an O-ring covering said single trigger cavity;

wherein said trigger cavity is formed inside said body of said retaining ring; and wherein said trigger cavity is configured to indicate that thickness of said retaining ring is less than or equal to a predetermined thickness threshold, and wherein said single trigger cavity extends inside said body of said retaining ring at a depth level that is greater than or equal to a threshold depth level corresponding to a predetermined thickness threshold; and wherein said single trigger cavity is filled with gas; and wherein said O-ring prevents said gas from escaping from said trigger cavity; and wherein said gas is selected from the group consisting of: {air, Helium, Neon, Argon, Krypton, and Xenon}.

2. A retaining ring for chemical mechanical polishing (CMP) apparatus comprising:

a body of said retaining ring;

and single trigger cavity; wherein said single trigger cavity further includes:

an O-ring covering said single trigger cavity;

wherein said trigger cavity is formed inside said body of said retaining ring; and wherein said trigger cavity is configured to indicate that thickness of said retaining ring is less than or equal to a predetermined thickness threshold, and wherein said single trigger cavity extends inside said body of said retaining ring at a depth level that is greater than or equal to a threshold depth level corresponding to a predetermined thickness threshold; and wherein said single trigger cavity is filled with fluid; and wherein said O-ring prevents said fluid from escaping from said trigger cavity; and wherein said fluid is selected from the group consisting of: {tap water, alcohols, glycols and water mixes}.

3. A retaining ring for chemical mechanical polishing (CMP) apparatus comprising:

a body of said retaining ring;

an integer N of trigger cavities;

and an integer M of O-rings, each said O-ring covering one said trigger cavity;

wherein a first trigger cavity is formed inside said body of said retaining ring; said first trigger cavity configured to indicate that thickness of said retaining ring is less than a first predetermined thickness threshold;

and wherein a second trigger cavity is formed inside said body of said retaining ring; said second trigger cavity configured to indicate that thickness of said retaining ring is less than a second predetermined thickness threshold;

and wherein each i-th trigger cavity is formed inside said body of said retaining ring; each said i-th trigger cavity configured to indicate that thickness of said retaining ring is less than an i -th predetermined thickness threshold; i being an integer less than or equal to N; and wherein each said trigger cavity covered with one said O-ring is filled with gas; and wherein each said O-ring prevents said gas from escaping from one said trigger cavity; and wherein said gas is selected from the group consisting of: {air, Helium, Neon, Argon, Krypton, and Xenon}, said integer M being less than or equal to N.

4. A retaining ring for chemical mechanical polishing (CMP) apparatus comprising:

a body of said retaining ring;

an integer N of trigger cavities;

and an integer L of O-rings, each said O-ring covering one said trigger cavity;

wherein a first trigger cavity is formed inside said body of said retaining ring; said first trigger cavity configured to indicate that thickness of said retaining ring is less than a first predetermined thickness threshold;

wherein a second trigger cavity is formed inside said body of said retaining ring; said second trigger cavity configured to indicate that thickness of said retaining ring is less than a second predetermined thickness threshold; and wherein each i-th trigger cavity is formed inside said body of said retaining ring; each said i-th trigger cavity configured to indicate that thickness of said retaining ring is less than an i -th predetermined thickness threshold; i being an integer less than or equal to N; and wherein each said trigger cavity covered with one said O-ring is filled with fluid; and wherein each said O-ring prevents said fluid from escaping from one said trigger cavity; and wherein said fluid is selected from the group consisting of: {tap water, alcohols, glycols and water mixes}, said integer L being less than or equal to N.

5. A method of replacing a retaining ring in a chemical mechanical polishing (CMP) apparatus, said retaining ring comprising a single trigger cavity formed inside said body of said retaining ring, and an O-ring covering said single trigger cavity; wherein each said trigger cavity covered with said O-ring is filled with gas; and wherein said O-ring prevents said gas from escaping from said trigger cavity; and wherein said gas is selected from the group consisting of: {air, Helium, Neon, Argon, Krypton, and Xenon}; said method comprising the steps of:

(A) filling said trigger cavity with said gas having a predetermined air pressure;

(B) substantially continuously measuring and maintaining said predetermined air pressure of said gas in said trigger cavity;

(C) performing a chemical mechanical polishing operation on a wafer by using said CMP apparatus having said retaining ring with said single trigger cavity under control of a computer loaded with a chemical mechanical polishing computer program;

(D) if said air pressure in said single trigger cavity changes beyond a predetermined threshold level, using said chemical mechanical polishing computer program to stop said process of performing said chemical mechanical polishing operation on said wafer;

(B) replacing said retaining ring;

and (F) repeating said steps (A–E).

6. The method of claim 5; wherein said step (A) further includes the step of:

(A1) pumping into said trigger cavity said gas having a predetermined positive air pressure by using said gas compressor; wherein said predetermined positive air pressure is greater than a normal air pressure; and wherein said step (D) further includes the step of:

(D1) if said air pressure in said single trigger cavity drops below a first predetermined threshold level, using said chemical mechanical polishing computer program to stop said process of performing said chemical mechanical polishing operation on said wafer.

7. The method of claim 5; wherein said step (A) further includes the step of:

(A2) pumping into said trigger cavity said gas having a predetermined negative air pressure by using a vacuum pump; wherein said predetermined negative air pressure is less than a normal air pressure; and wherein said step (D) further includes the step of:

(D2) if said air pressure in said single trigger cavity increases above a second predetermined threshold level, using said chemical mechanical polishing computer program to stop said process of performing said chemical mechanical polishing operation on said wafer.

8. A method of replacing a retaining ring in a chemical mechanical polishing (CMP) apparatus, said retaining ring comprising a single trigger cavity formed inside said body of said retaining ring, and a O-ring covering said single trigger cavity; wherein said trigger cavity covered with said O-ring is filled with fluid; and wherein said O-ring prevents said fluid from escaping from said trigger cavity; and wherein said fluid is selected from the group consisting of: {tap water, alcohols, glycols and water mixes}; said method comprising the steps of:

(A) filling said trigger cavity with said fluid having a predetermined fluid pressure by using a fluid pump;

(B) substantially continuously measuring and maintaining said fluid pressure of said fluid in said trigger cavity;

(C) performing a chemical mechanical polishing operation on a wafer by using said CMP apparatus having said retaining ring with said single trigger cavity under control of a computer loaded with a chemical mechanical polishing computer program;

(D) if pressure of said fluid pressure in said single trigger cavity drops below a predetermined threshold level, using said chemical mechanical polishing computer program to stop said process of performing said chemical mechanical polishing operation on said wafer;

(E) replacing said retaining ring;

and (F) repeating said steps (A–E).

9. A method of replacing a retaining ring in a chemical mechanical polishing (CMP) apparatus; said retaining ring comprising; a body; an integer N of trigger cavities; and an integer M of an O-rings; each said O-ring covering one said trigger cavity; wherein each said trigger cavity covered with one said O-ring is filled with gas; and wherein each said O-ring prevents said gas from escaping from one said trigger cavity; and wherein said gas is selected from the group consisting of: {air, Helium, Neon, Argon, Krypton, and Xenon}; wherein said first trigger cavity extends inside said body of said retaining ring at a first depth level $L_1$; wherein said second trigger cavity extends inside said body of said retaining ring at a second depth level $L_2$; and wherein each said k-th trigger cavity extends inside said body of said retaining ring at a k-th depth level $L_k$; wherein $L_1 \geqq L_2 \geqq \ldots L_k \ldots \geqq L_N$, k being an integer less than or equal to N; said method comprising the steps of:

(A) filling each said trigger cavity with one said gas;

(B) substantially continuously measuring air pressure in each said trigger cavity;

(C) performing a chemical mechanical polishing operation on a wafer by using said CMP apparatus having said retaining ring with said plurality of trigger cavities under control of a computer loaded with a chemical mechanical polishing computer program;

(D) if air pressure in said i-th trigger cavity changes beyond an i-th predetermined threshold level, using said chemical mechanical polishing computer program to issue an i-th warning signal; i being an integer less than N;

(E) repeating said step (D) for each said i-th trigger cavity;

(F) if air pressure in said N-th trigger cavity changes beyond an N-th predetermined threshold level, using said chemical mechanical polishing computer program to stop said process of performing said chemical mechanical polishing operation on said wafer;

(G) replacing said retaining ring;

and (H) repeating said steps (A–G).

10. A method of replacing a retaining ring in a chemical mechanical polishing (CMP) apparatus; said retaining ring comprising; a body; an integer N of trigger cavities; and an integer M of an O-rings; each said O-ring covering one said trigger cavity; wherein each said trigger cavity covered with one said O-ring is filled with fluid; and wherein each said O-ring prevents said fluid from escaping from one said trigger cavity; and wherein said fluid is selected from the group consisting of: {tap water, alcohols, glycols and water mixes}; wherein said first trigger cavity extends inside said body of said retaining ring at a first depth level $L_1$; wherein said second trigger cavity extends inside said body of said retaining ring at a second depth level $L_2$; and wherein each said k-th trigger cavity extends inside said body of said retaining ring at a k-th depth level $L_k$; wherein $L_1 \geqq L_2 \geqq \ldots L_k \ldots \geqq L_N$, k being an integer less than or equal to N; said method comprising the steps of:

(A) filling each said trigger cavity with one said fluid;

(B) substantially continuously measuring and maintaining a fluid pressure in each said trigger cavity;

(C) performing a chemical mechanical polishing operation on a wafer by using said CMP apparatus having said retaining ring with said plurality of trigger cavities under control of a computer loaded with a chemical mechanical polishing computer program;

(D) if pressure of said selected fluid in said i-th trigger cavity drops below an i-th predetermined threshold, using said chemical mechanical polishing computer program to issue an i-th warning signal; i being an integer less than N;

(E) repeating said step (D) for each said i-th trigger cavity;

(F) if pressure of said selected fluid in said N-th trigger cavity drops below an N-th predetermined threshold, using said chemical mechanical polishing computer program to stop said process of performing said chemical mechanical polishing operation on said wafer;

(G) replacing said retaining ring;

and (H) repeating said steps (A–G).

11. A chemical mechanical polishing (CMP) apparatus comprising a retaining ring further comprising at least one trigger cavity formed inside said body of said retaining ring, and at least one an O-ring, each said O-ring covering one said single trigger cavity; wherein each said trigger cavity covered with one said O-ring is filled with gas; and wherein each said O-ring prevents said gas from escaping from one said trigger cavity; and wherein said gas is selected from the group consisting of: {air, Helium, Neon, Argon, Krypton, and Xenon}; said CMP apparatus comprising;

a means for filling each said trigger cavity with said gas having a predetermined air pressure;

a means for substantially continuously measuring and maintaining said air pressure of said gas in each said trigger cavity;

a means for performing a chemical mechanical polishing operation on a wafer by using said CMP apparatus having said retaining ring with at least one said single trigger cavity;

a means for issuance warning signals;

a means for stopping said (CMP) apparatus;

and a means for replacing said retaining ring with said at least one trigger cavity.

12. A chemical mechanical polishing (CMP) apparatus comprising a retaining ring further comprising at least one trigger cavity formed inside said body of said retaining ring, and at least one O-ring, each said O-ring covering one said trigger cavity; wherein each said trigger cavity covered with one said O-ring is filled with fluid; and wherein each said O-ring prevents said fluid from escaping from one said trigger cavity; and wherein said fluid is selected from the group consisting of: {tap water, alcohols, glycols and water mixes}; said CMP apparatus comprising;

a means for filling each said trigger cavity with said fluid having a predetermined fluid pressure;

a means for substantially continuously measuring and maintaining said fluid pressure of said fluid in each said trigger cavity;

a means for performing a chemical mechanical polishing operation on a wafer by using said CMP apparatus having said retaining ring with at least one said single trigger cavity;

a means for issuance warning signals;

a means for stopping said (CMP) apparatus;

and a means for replacing said retaining ring with said at least one trigger cavity.

* * * * *